US005837913A

United States Patent [19]

Newman

[11] Patent Number: 5,837,913

[45] Date of Patent: Nov. 17, 1998

[54] PLECTRUM HOLDER AND METHOD FOR USING THE SAME

[76] Inventor: John E. Newman, 358 Union St., Ashland, Mass. 01721

[21] Appl. No.: 698,974

[22] Filed: Aug. 16, 1996

[51] Int. Cl.[6] ..... G10D 3/00

[52] U.S. Cl. ..... 84/329; D17/22

[58] Field of Search ..... 84/329, 322, 453; D17/22

[56] References Cited

U.S. PATENT DOCUMENTS

| | | | |
|---|---|---|---|
| 291,809 | 1/1884 | Tenant . | |
| D. 362,264 | 9/1995 | Trees | D17/20 |
| 557,293 | 3/1896 | Wahl | 84/329 |
| 2,776,592 | 1/1957 | DiPreta . | |
| 3,648,558 | 3/1972 | Chenette . | |
| 3,650,172 | 3/1972 | Osborne . | |
| 3,699,838 | 10/1972 | Montgomery . | |
| 4,137,814 | 2/1979 | Rowley | 84/322 |
| 4,982,641 | 1/1991 | Duhart | 84/329 |
| 5,413,020 | 5/1995 | Thompson | 84/329 |

*Primary Examiner*—Cassandra C. Spyrou
*Attorney, Agent, or Firm*—Eckert Seamans Cherin & Mellott, LLC

[57] ABSTRACT

A novel apparatus for holding a plectrum in graspable relation to a hand is taught which comprises a hand engaging portion, a resilient member, fastening elements, and a plectrum. The hand engaging portion is adapted to engage a portion of the musician's hand, and to be fastened to a proximal end of the resilient member. A distal end of the resilient member is fastened to the plectrum. Preferably, the proximal end of the resilient member is fastened to the hand engaging portion so that the resilient member projects outwardly from the hand, with the distal end of the resilient member positioned in spaced-relation to the hand. The distal end of the resilient member is fastened to the plectrum so that the plectrum is held (i) in graspable relation to the musician's fingers, and (ii) in a preferred orientation relative to the musician's fingers. A novel method of playing a stringed instrument is also taught.

1 Claim, 7 Drawing Sheets

PLECTRUM HOLDER AND METHOD FOR USING THE SAME

FIELD OF THE INVENTION

The present invention generally relates to devices used in playing a stringed instrument, and more particularly to devices used to maintain a plectrum in position within a musician's hand while the musician plays the instrument with his fingers.

BACKGROUND OF THE INVENTION

Traditionally stringed instruments, such as guitars, banjos and the like, are played by plucking the strings with either the fingers or a plectrum. In some musical compositions, the musician may be called upon to alternate between plucking the strings with his fingers and plucking the strings with a plectrum. This need creates the problem of holding the plectrum safely in reserve while the musician plucks the strings with his fingers. In particular, the plectrum must be held securely in a convenient position, nearby, so as to be readily retrievable without introducing undesirable delays into the musical arrangement. Also, from time to time, a musician will accidentally drop the plectrum during a performance. This is not only embarrassing, but also may cause a momentary time lapse while the musician stops playing in order to retrieve the plectrum.

Consequently, many devices and techniques have been introduced over the years for solving these problems. See, for example, U.S. Pat. Nos. 2,776,592, issued to M. S. DiPreta, on Aug. 7, 1953; 3,648,558, issued to John E. Chenette, on Mar. 14, 1972; 3,650,172, issued to Robert D. Osborne, on Mar. 21, 1972; 3,699,838, issued to Edgar L. Montgomery, on Oct. 24, 1972; 4,137,814, issued to Peter C. Rowley, on Feb. 6, 1979; Des. 291,809, issued to Robert S. Jasper, on Sep. 8, 1987; and 4,982,641, issued to Dean K. Duhart, on Jan. 8, 1991. Unfortunately, none of the plectrum holding devices and techniques developed to date are completely satisfactory. Some of these known devices are not effective enough during use; others can be inconvenient to use, particularly in a performance setting.

For example, in U.S. Pat. No. 2,776,592, issued to M. S. DiPreta, a guitar pick is attached to the hand by means of a clamping band disposed around the forefinger. The guitar pick comprises an integral, outwardly-extending, flexible tongue that is pivotally attached to the clamping band. Unfortunately, DiPreta's device is required to be worn close to the finger tip of the musician so that it may be swiveled into and out of playing position. This positioning may be cumbersome for some musicians, as it may interfere with the movement of the forefinger during finger-picking.

By way of a further example, in U.S. Pat. No. 4,982,641, issued to Dean K. Duhart, a guitar pick holder is attached to the arm of the musician by an arm band, with the pick fastened to the arm band by a tether line. This device causes less interference with the musician's fingers during finger-picking. Unfortunately, the pick is left to dangle uncontrollably from the arm of the musician, making it difficult to retrieve the pick quickly.

As a consequence, there has been a long felt need for a plectrum holder that is capable of securely holding a plectrum safely in reserve so that it may be easily retrieved without introducing undesirable delays into the musical performance.

OBJECTS AND SUMMARY OF THE INVENTION

It is therefore a primary object of the present invention to provide a novel apparatus for holding a plectrum in graspable relation to a musician's hand with all the aforementioned needs substantially met.

Another object of the present invention is to provide a plectrum holder that maintains a plectrum in easily retrievable relation to a musician's finger tips, while that musician is finger-picking a stringed instrument, but that does not interfere with the finger-picking technique of the musician.

And another object of the present invention is to provide a plectrum holder that maintains a plectrum in a preferred orientation relative to a musician's fingers.

Still another object of the present invention is to provide a novel apparatus for holding a plectrum in graspable relation to a musician's fingers comprising a resilient member that projects outwardly from the palm-side of a musician's hand.

Yet another object of the present invention is to provide a novel apparatus for holding a plectrum in graspable relation to a musician's fingers wherein the plectrum is disposed in spaced-relation to the palm-side of the musician's hand while the musician is finger-picking a stringed instrument.

A further object of the present invention is to provide a novel method of playing a stringed instrument.

These and other objects of the present invention are achieved through the provision and use of a novel apparatus for holding a plectrum in graspable relation to a hand comprising means for engaging a portion of the hand, a resilient member, fastening means, and a plectrum. More particularly, hand engaging means are adapted to engage a portion of the musician's hand, and to be fastened to a proximal end of the resilient member. A distal end of the resilient member is fastened to the plectrum. Preferably, the proximal end of the resilient member is fastened to the hand engaging means so that the resilient member projects outwardly from the palm-side of the musician's hand, with the distal end of the resilient member positioned in spaced-relation to the hand. The distal end of the resilient member is fastened to the plectrum by fastening means so that the plectrum is held in a musician-selected orientation relative to the musician's fingers.

In one preferred method for playing a stringed instrument, a musician may alternate between plucking at least one string of a stringed musical instrument with the fingers of his hand and plucking at least one string with a plectrum held in that same hand without substantially altering the tempo of the particular musical composition being performed. The method comprises the steps of first fastening a plectrum in graspable relation to the musician's hand. The musician then bends the thumb and forefinger of his hand so as to form a pincer-like configuration wherein the forefinger is fully bent at a first and a second knuckle and the thumb is fully bent at a first knuckle, and with the forefinger's tip and the thumb's tip being disposed in opposing spaced-relation to one another. The musician then grasps the plectrum between his thumb and forefinger and pulls the plectrum outwardly and away from his hand so as to place the plectrum in a string-engaging position. The musician then engages at least one string of the stringed instrument with the plectrum for a predetermined period of time as defined by the musical composition. The musician may then release and regrasp the plectrum as often as is required by the musical composition.

BRIEF DESCRIPTION OF THE DRAWINGS

These and other objects, features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
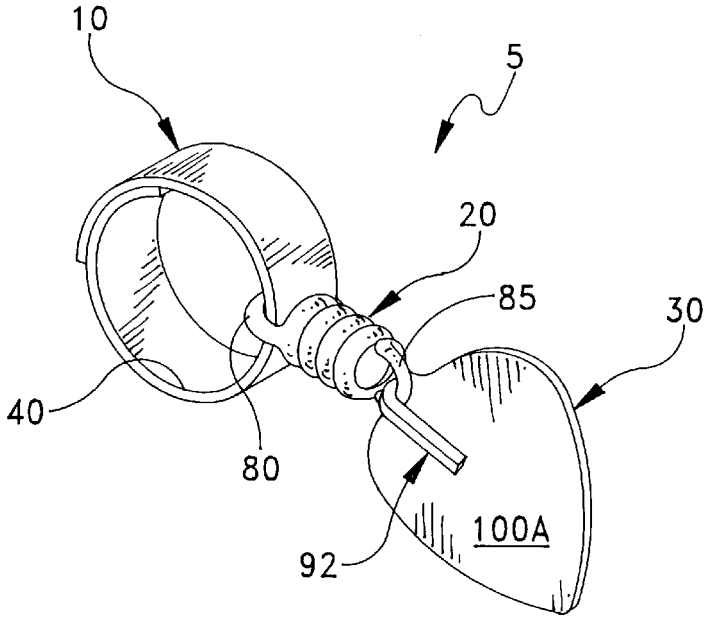
FIG. 1 is a perspective view of a plectrum holder formed in accordance with one embodiment of the present invention.

Referring first to FIG. 1, a plectrum holder 5 formed in accordance with the present invention generally comprises hand engaging means 10, a resilient member 20, and a plectrum 30. More particularly, hand engaging means 10 are generally annular in shape, with an inner diameter that is sized to receive a portion of the musician's hand. In one preferred embodiment, hand engaging means 10 comprise a loop or ring 40 that is sized and shaped to be positioned on a musician's finger. Loop or ring 40 may comprise a continuous or discontinuous hoop of any material that is suitable for use in connection with human fingers, such as various known polymers, metals, fabrics, animal-derived products, etc.

Figure 2:
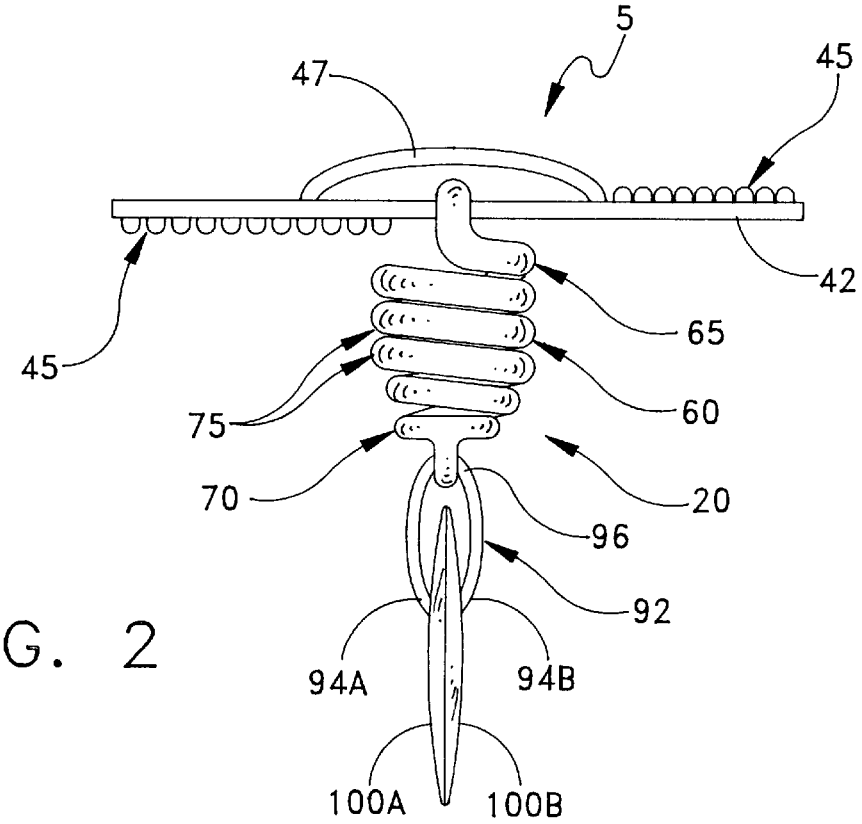
FIG. 2 is a side view of a plectrum holder, similar to that shown in FIG. 1, but with the loop unfurled and a proximally disposed mechanical swivel fastener.

By way of example, and not of limitation, loop or ring 40 may be formed from a strip of fabric 42 (FIG. 2). Strip 42 is typically about 1 to 4 inches in length and about 0.25 to 1.0 inches in width. Cooperative fasteners 45 are disposed on corresponding portions of strip 42 so that strip 42 may be looped onto itself, about a central axis, so as to form a ring. It will be appreciated that fasteners 45 may comprise any of the known fabric fasteners such as buttons, snaps, hooks, Velcro®-type hook and felt fasteners or adhesives. As shown in FIG. 2, a second strip of fabric 47 may be disposed on the inner mid-portion of strip 42 so as to provide a means for retaining resilient member 20 in position on loop or ring 40. Alternatively, strip of fabric 47 may be disposed on a free end of strip 42 in order to provide a pull-off tab. It will be understood that strip 42 may also be formed from a plurality of discrete strips.

Resilient member 20 generally comprises a substantially elastic element that does not have a tendency to droop or bend under its own weight when it is cantilevered at one end. Advantageously, resilient member 20 may be stretched to at least twice its unbiased length when placed under relatively light tension. Preferably, resilient member 20 will comprise a relatively light spring constant in the range from no more than a gram to several grams per inch in order to facilitate the easy extension of resilient member 20 from its unbiased state to its biased state. For example, resilient member 20 may preferably comprise a spring constant in the range from about 0.25 grams per inch to about 14 grams per inch. Of course, it will be understood that stiffer spring constants may be selected to suit a particular musician's needs.

In one preferred embodiment of the present invention, resilient member 20 comprises a low spring-constant tension spring 60. More particularly, and referring to FIG. 2, spring 60 includes a proximal portion 65, a distal portion 70 and a plurality of helical coils 75. The length of spring 60, between proximal portion 65 and distal portion 70, may vary depending upon the size of a particular musician's hand and fingers. For example, in its normal unbiased state, spring 60 is typically about one-half to two inches in length. In a biased state (seen in FIG. 3) spring 60 may extend to over three or more inches in length. Spring 60 may be formed from any of the well known metals, polymers, or elastomeric compounds that are adapted for use as spring materials.

Figure 3:
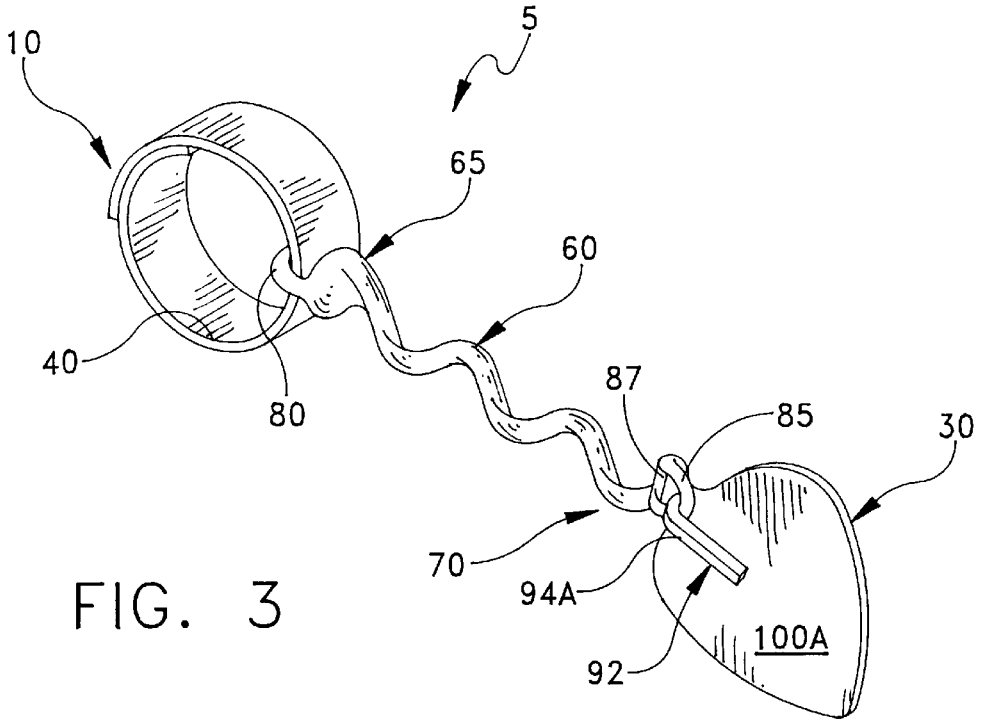
FIG. 3 is a side view of the plectrum holder shown in FIG. 1, with a biased resilient member in the form of a tension spring.
Figure 4:
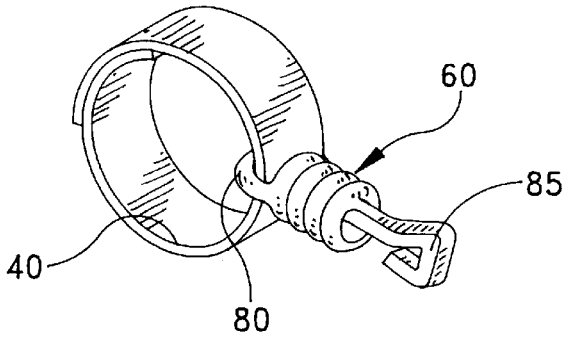
FIG. 4 is a perspective view of a partially assembled plectrum holder, showing a resilient member fastened to a ring in a preferred orientation.
Figure 5:
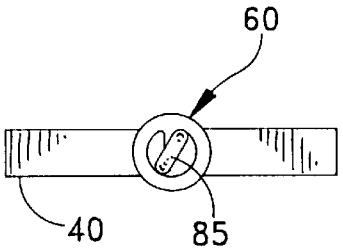
FIG. 5 is a top view of the plectrum holder shown in FIG. 4.
Figure 6:
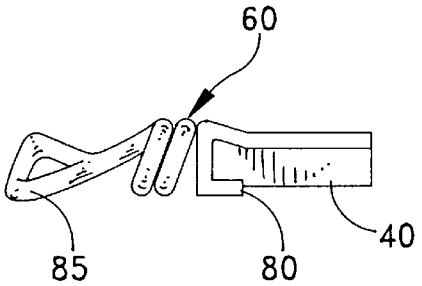
FIG. 6 is a side view of the plectrum holder shown in FIG. 4.

Referring now to FIG. 3, proximal portion 65 and distal portion 70 preferably comprise means for fastening spring 60 to hand engaging means 10 and plectrum 30. For instance, proximal portion 65 may comprise fastener 80 and distal portion 70 may comprise fastener 85 each being formed as either an integral portion of spring 60 or as a portion of a separate element that is fastened to spring 60. For example, as shown in FIGS. 1–6, fastener 80 may comprise a generally semicircular-shaped hook having a diameter that is large relative to the width of a portion of hand engaging means 10. In this embodiment the semicircular shape of fastener 80 allows fastener 80 to hook onto and engage loop or ring 40. Of course, it will be appreciated that other fastening means may be used in connection with proximal portion 65, such as adhesives, stitching, mechanical clips, rivets 67 (FIGS. 13A and 13B), welding or, hand engaging means 10 and resilient member 20 may be formed as a single, integral unit. Fastener 85 is disposed on distal portion 70 of spring 60, and is adapted to attach plectrum 30 to spring 60. More particularly, fastener 85 may comprise an eyelet 87 (FIGS. 3–6), a mechanical clasp 89 (shown in general form in FIG. 13) or other fastening devices (e.g., a hook, a magnetic clasp, an adhesive pad, etc.). It has been found to be advantageous to form fastener 85 so as to place eyelet 87 or mechanical clasp 89 in spaced relation to coils 75, as shown in FIGS. 4 and 6. This is particularly significant since it allows the musician to more comfortably grasp and hold plectrum 30.

Referring to FIGS. 1 and 3–12, fasteners 80 and 85 are often rotated relative to one another about the longitudinal axis of spring 60 in order to position plectrum 30 in a preferred orientation for retrieval by the musician. More particularly, fasteners 80 and 85 are typically rotated relative to one another so as to form angles in the range from about 0° to about 180°, with an angle in the range of from about 0° to about 90°, e.g. about 45°, being preferred. The relative rotation of fasteners 80 and 85 may be a fixed relationship or, it may be a variable relation that is selected by the musician (see FIG. 14). This relative rotation is advantageous inasmuch as it allows the musician to select a preferred orientation for grasping the plectrum, as will hereinafter be disclosed in further detail.

In one preferred embodiment of the present invention, a binding element 92 may be utilized to fasten plectrum 30 to eyelet 87 (FIGS. 1–3). More particularly, binding element 92 typically comprises a fillet formed from a polymer, metal, elastomeric compound or fabric. Binding element 92 comprises end portions 94A and 94B that are adapted to be fastened to plectrum 30, as will hereinafter be disclosed in further detail Preferably, binding element 92 has a length of about 0.5 to about 4 inches and a width of about 0.125 to about 0.5 inches. By way of example, and not of limitation, binding element 92 may comprise a piece of stiff fabric having a Velcro®-type fastener disposed on end portions 94A and 94B. Binding element 92 may further comprise means for enhancing a musician's grip on plectrum 30, such as serrations, sand paper, etc. Of course, it will be appreciated that mechanical fastening means of the type that are well known in the art may also be used to fasten plectrum 30 to spring 60. For example, a mechanical clasp 89 (FIG. 13) may be attached to distal portion 70 at one end and may be mechanically clamped onto plectrum 30 at the other end.

Plectrum 30 is of the type well known in the art, e.g., a relatively thin piece of flexible metal, polymer, ivory, or the like. Plectrum 30 may have any substantially polygonal or curved shape consistent with holding the plectrum between the thumb and at least one finger. Very often, plectrum 30 will have a substantially triangular shape comprising two relatively large surfaces 100A and 100B (FIGS. 1–3 and 7–8). Plectrum 30 may also include corresponding fastening means for engaging fastener 85 or binding element 92, such as a corresponding hook, clasp, or strip of Velcro®. In the case where adhesive means are to be used to fasten plectrum 30 to spring 60, plectrum 30 may be completely unaltered.

Plectrum holder 5 is assembled in the following manner.

Referring to FIGS. 1–10, plectrum 30 is first fastened to resilient member 20. For example, resilient member 20 may comprise spring 60, where spring 60 further comprises an eyelet 87 disposed on distal portion 70. In this case, binding element 92 may be used as a fastening means for fastening spring 60 to an edge of plectrum 30. More particularly, an end portion 94A or 94B is attached to either surface 100A or 100B of plectrum 30. To this end, fastening means such as an adhesive or a strip of Velcro® may be disposed on end portions 94A and 94B of binding element 92 and/or on surfaces 100A and 100B. Binding element 92 may then be threaded through eyelet 87 so that the free end portion 94A or 94B may be affixed to surface 100A or 100B leaving an eyelet-engaging portion 96 projecting outwardly from an edge of plectrum 30 and through eyelet 87 (FIGS. 2–3 and 7–10). Alternatively, end portions 94A and 94B may be first fastened to surfaces 100A and 100B, respectively, thus forming eyelet-engaging portion 96 on plectrum 30 as a subassembly. This subassembly may then be fastened to distal portion 70 via a hook-shaped fastener or the like.

Referring now to FIGS. 7–10, it will be appreciated that two separate angular relationships will govern the orientation of plectrum 30 on distal portion 70 of spring 60. More particularly, the relative rotation of fastener 85 with respect to the longitudinal axis of spring 60 will determine a first angular orientation of the plectrum, and the degree of rotation of plectrum 30 about an axis projecting perpendicularly from its surfaces 100A and 100B will determine a second angular orientation. The first angular orientation determines the position at which the plectrum is presented to the musician for grasping. The second angular orientation determines the position at which the plectrum "attacks" or engages the strings of the stringed instrument.

Figure 7:
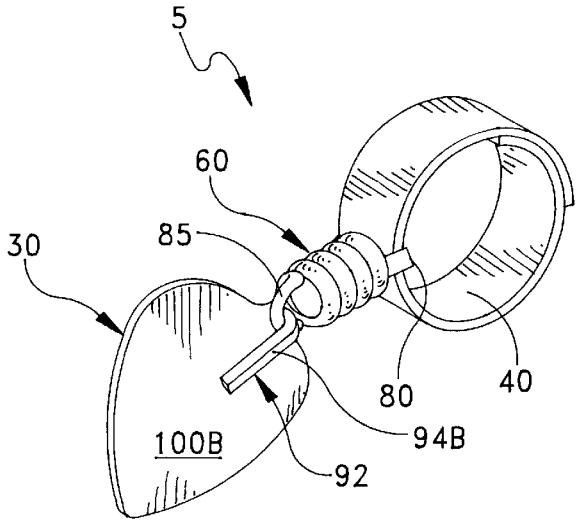
FIG. 7 is a perspective view of a plectrum holder similar to that illustrated in FIG. 1, but showing one possible musician-selected orientation of the plectrum relative to a resilient member.
Figure 8:
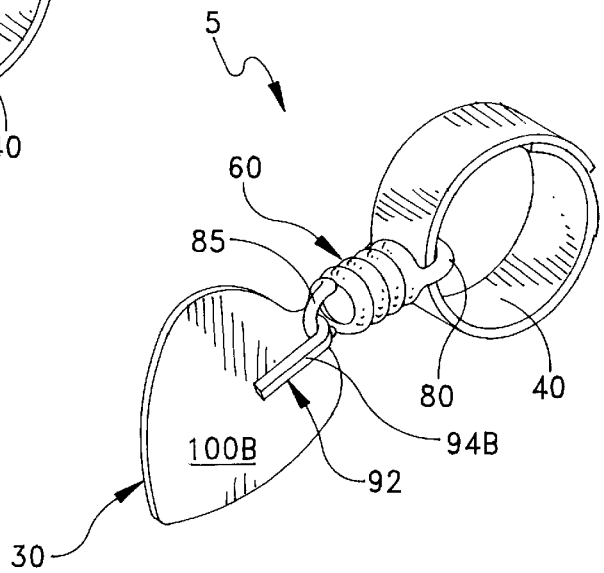
FIG. 8 is a perspective view of the plectrum holder similar to that illustrated in FIG. 1, but showing another possible musician-selected orientation of the plectrum relative to a resilient member.
Figure 9:
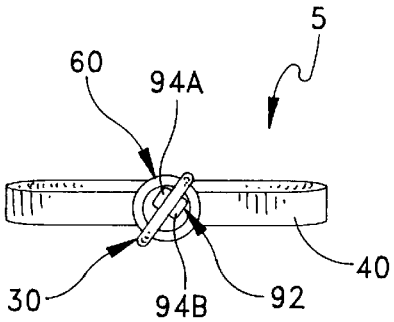
FIG. 9 is a top view of a plectrum holder, similar to that shown in FIG. 7.
Figure 10:
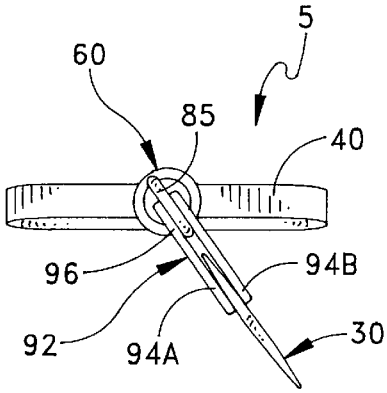
FIG. 10 is a top view of a plectrum holder, similar to that shown in FIG. 8.

For example, and still referring to FIGS. 7–10, plectrum 30 may be disposed on distal portion 70 at an angle in the range from about 0° to about 180° depending upon the musician's preference for grasping the plectrum when he switches from finger-picking to plectrum picking of the instrument. It has been found that an angle in the range of from about 0° to about 90° (e.g., at about the "2:00" position) is preferred by most guitarists. The second angular orientation of plectrum 30 may be at any angle between about 0° and about 180°, as measured relative to an axis projecting perpendicularly from surfaces 100A and 100B of plectrum 30, again depending upon the preference of the musician (FIGS. 7 and 8). It will be appreciated that the "attack" angle of the plectrum relative to the string(s) is preferably about 45°. It will be understood that the attack angle will normally have significant influence on the relative tension needed to bias resilient member 20.

Figure 14:
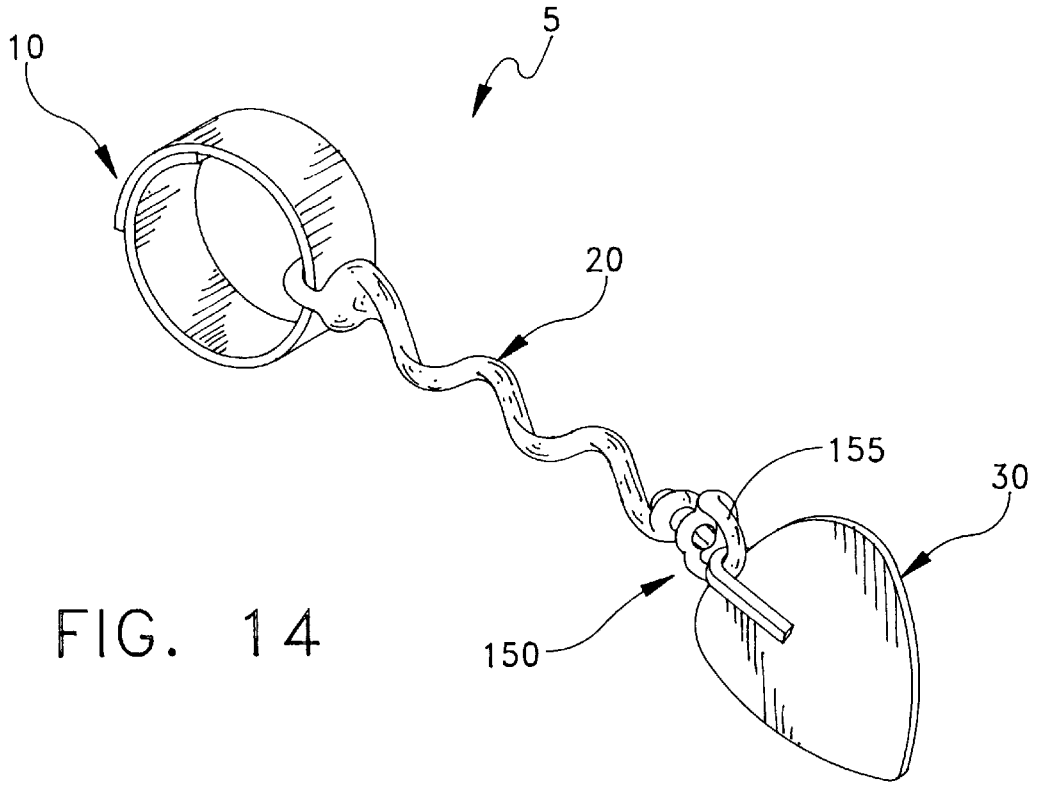
FIG. 14 shows an alternative embodiment of fastener adapted to allow the plectrum to selectively swivel.
Figure 15:
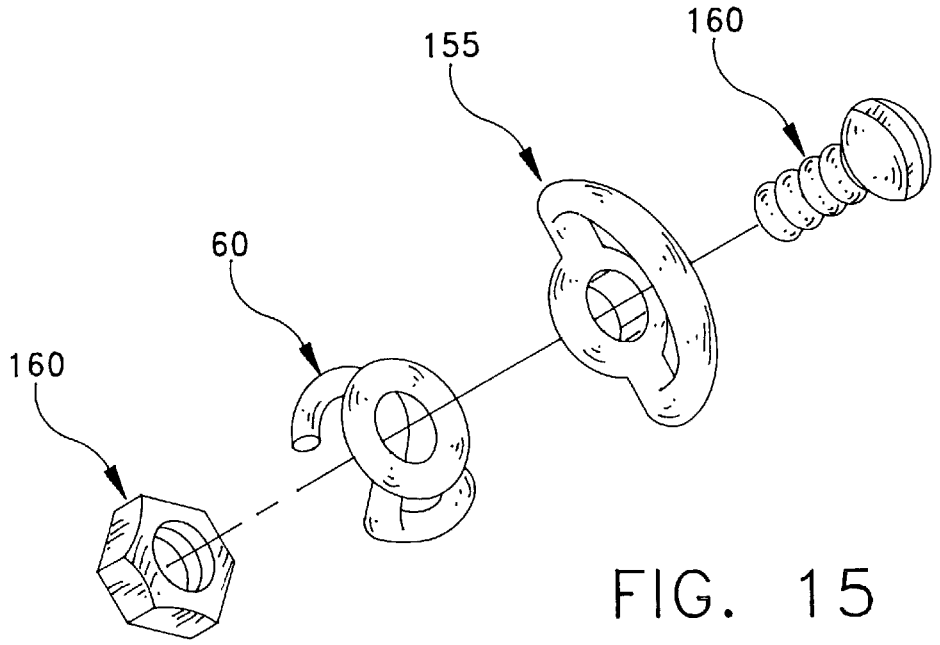
FIG. 15 is an exploded view, partially in section, of a swivel mechanism formed in accordance with the present invention.

Advantageously, both the "attack" and "grasping" angles may be selected by the musician. More particularly, fastener 85 may be adapted so as to allow the musician to adjust the angular position of plectrum 30. For example, when plectrum 30 is fastened to resilient member 20 by a Velcro -type fastener, mechanical clasp, or the like, the musician may simply unfasten plectrum 30, rotate plectrum 30 so as to change the attack angle, and then refasten plectrum 30 to resilient member 20. The grasping angle may be preselected by choosing from a plurality of resilient members having varying angular relationships between fastener 80 and fastener 85. Alternatively, the grasping angle may be rotationally adjustable by means of a swivel mechanism 150 as shown in FIGS. 14 and 15. In connection with the use of spring 60, swivel mechanism 150 may comprise a rotatable eyelet 155 and fastening means 160. Eyelet 155 is rotatably mounted to distal portion 70 of spring 60 via fastening means 160, such as a screw and nut arrangement. In this way, the first angular orientation of plectrum 30 may be adjusted by the musician by simply loosening fastening means 160, rotating eyelet 155 to a preferred position, and retightening fastening means 160. Alternatively, swivel mechanism 150 may be adapted to ratchet selectively between a plurality of angular positions. It will be appreciated, of course, that fastener 80 may be replaced with a swivel mechanism 150 so as to allow for selective rotation of resilient member 20 relative to hand engaging means 10.

Referring again to FIGS. 1–3, hand engaging means 10, in the form of loop or ring 40, may be formed from strip of fabric 42. More particularly, a relatively stiff fabric, such as canvas, is cut to form an approximately 4 inch long and approximately 0.25 inch wide strip. Cooperative fasteners 45, such as Velcro® -type hook and felt fasteners, are disposed on corresponding portions of strip 42 so that strip 42 may be doubled onto itself so as to form loop or ring 40 having the approximate inner diameter of the musician's middle finger.

To complete the assembly of plectrum holder 5, resilient member 20 and plectrum 30 are fastened to hand-engaging means 10. For example, fastener 80 may simply be fastened onto strip 42 by any of the fastening means previously disclosed hereinabove, such as rivet 67, so that resilient member 20 projects outwardly from hand engaging means 10 (see, FIGS. 1–10). Alternatively, fastener 80 may be adapted to engage a piece of jewelry being worn by the musician, such as a decorative ring worn on a finger. In this position, plectrum 30 is disposed in spaced-relation to hand-engaging means 10. Plectrum holder 5 may now be positioned on the musician's hand.

Figure 11:
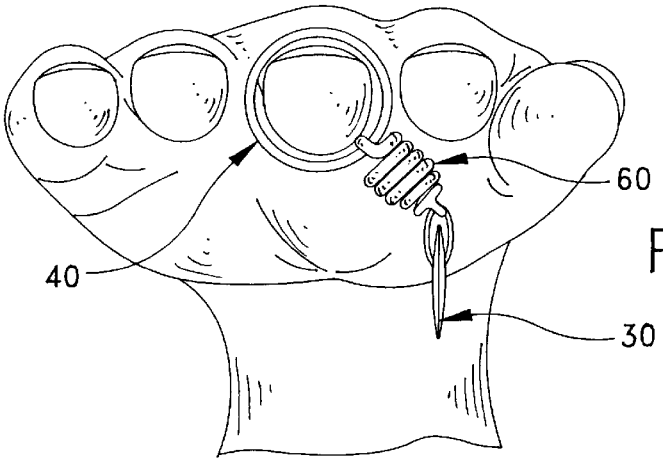
FIG. 11 is a perspective view of a musician's hand with a plectrum holder formed in accordance with the present invention disposed on the musician's middle finger and with the resilient member and the plectrum oriented in a preferred position relative to the musician's thumb and index fingers.
Figure 12:
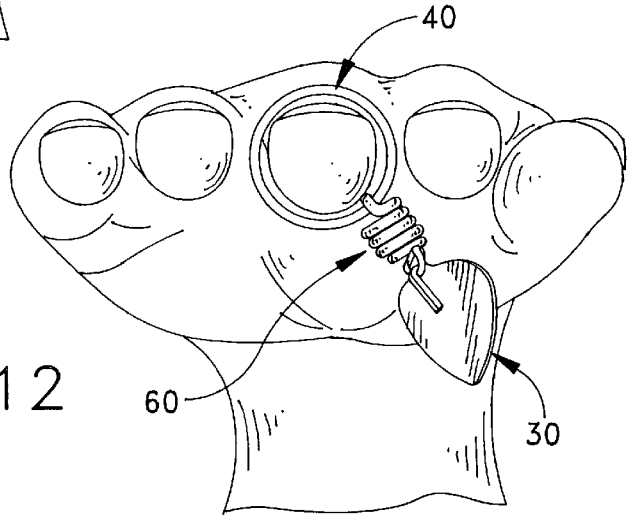
FIG. 12 is a perspective view of a musician's hand with a plectrum holder formed in accordance with the present invention disposed on the musician's middle finger and with the resilient member and the plectrum oriented in another preferred position relative to the musician's thumb and index fingers.

More particularly, a plectrum holder 5 is first selected having a resilient member 20 of an appropriate length based on the musician's hand size and an appropriate first angular orientation between plectrum 30 and hand engaging means 10. Hand engaging means 10 are then slipped onto the musicians hand. Preferably, hand engaging means 10 are positioned at the base of the musician's middle finger (FIGS. 11 and 12) so that resilient member 20 projects outwardly from the palm-side of the musician's hand preferably toward the thumb. The musician may determine whether the resilient member has been properly selected in the following manner. With plectrum holder 5 in position on the middle finger of the musician's hand, the musician touches the tip of each finger to the tip of the thumb on the same hand (FIG. 13A). If the musician is able to perform this test, without simultaneously substantially touching the plectrum with the tips of his fingers, then the resilient member 20 has been properly selected by the musician. As shown in FIGS. 11 and 12, plectrum holder 5 may be oriented, relative to the musician's hand, in a plurality of positions so as to provide for the comfort of the musician.

Figure 13:
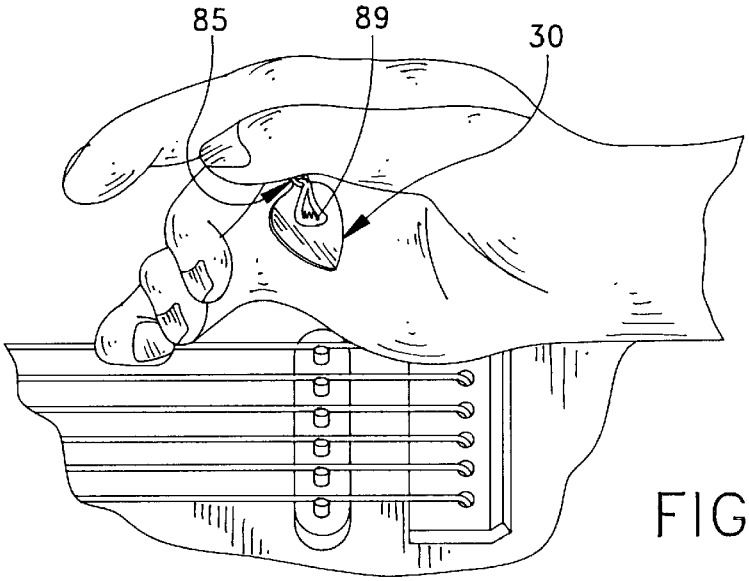
FIG. 13 is a perspective view of a musician's hand in relation to the strings of a guitar, with a plectrum holder formed in accordance with the present invention disposed on the musician's hand and with the plectrum oriented in a preferred position relative to the musician's fingers.
Figure 13A:
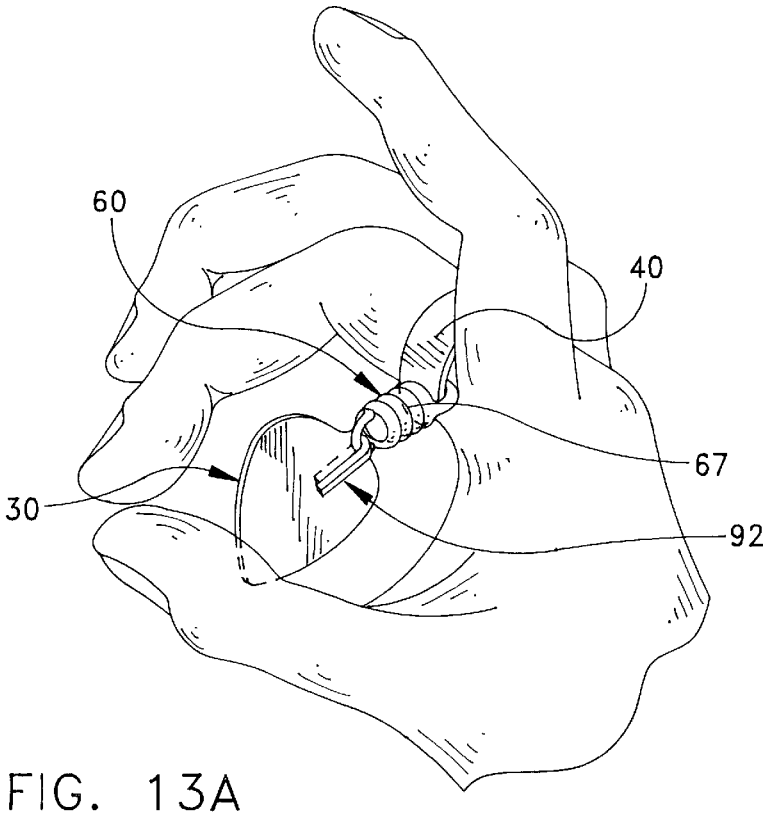
FIG. 13A is a perspective view of a musician's hand with a plectrum holder formed in accordance with the present invention disposed on a finger wherein the musician is touching his finger tips to his thumb tip.
Figure 13B:
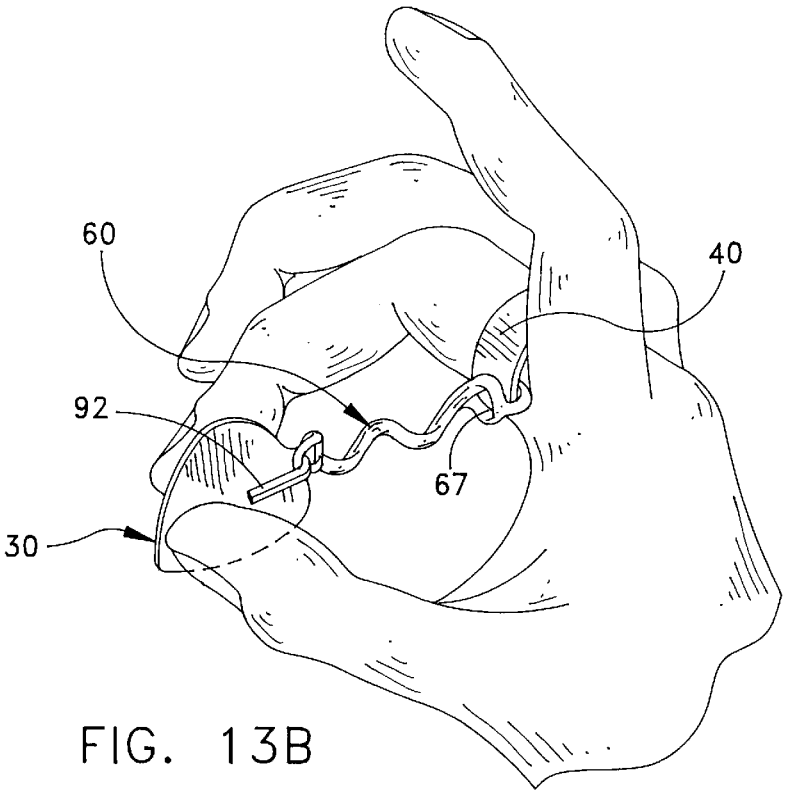
FIG. 13B is a perspective view of a musician's hand with a plectrum holder formed in accordance with the present invention disposed on a finger and the plectrum grasped between the musician's thumb and finger tip.

Referring now to FIGS. 11–13, plectrum holder 5 may be used to play a stringed instrument in the following manner.

More particularly, with the plectrum holder in position on the musician's hand (FIG. 13B), and once the musician has completed a portion of a musical composition that requires finger-picking, the musician must grasp the plectrum with his thumb and at least a finger, preferably either the forefinger or the middle finger or both. This may be accomplished, for example, by first bending the thumb and finger so as to form a pincer-like "C-shaped" configuration (i.e., where the finger is bent at each of its joints and the thumb is bent at each of its joints) with the finger and thumb tips disposed in opposing spaced-relation to one another. In this position, the plectrum will be disposed in graspable relation to the musician's hand, i.e., positioned substantially between the tip of the finger and the tip of the thumb. Next, plectrum 30 is grasped between the thumb and finger tip while simultaneously being pulled outwardly and away from the palm-side of the musician's hand. It will be appreciated that this may be accomplished with little force, do to the relatively low spring constant of resilient member 20. Once the musician has finished using the plectrum, he or she simply releases the plectrum which is then drawn back toward the palm-side of the musician's hand under the influence of resilient member 20. In this arrangement, the musician may regrasp and release plectrum 30 as often as is required by the particular musical composition.

MODIFICATIONS

It will be appreciated that various changes, modifications and alterations may be made to the various exemplary embodiments described hereinabove without departing from the scope or spirit of the present invention.

For example, plectrum holder 5 or any portion thereof may be formed as one integral polymer molding.

In another example, hand engaging means 10 may comprise a band adapted to be worn on any finger or about the palm of the musician's hand.

Figure 16:
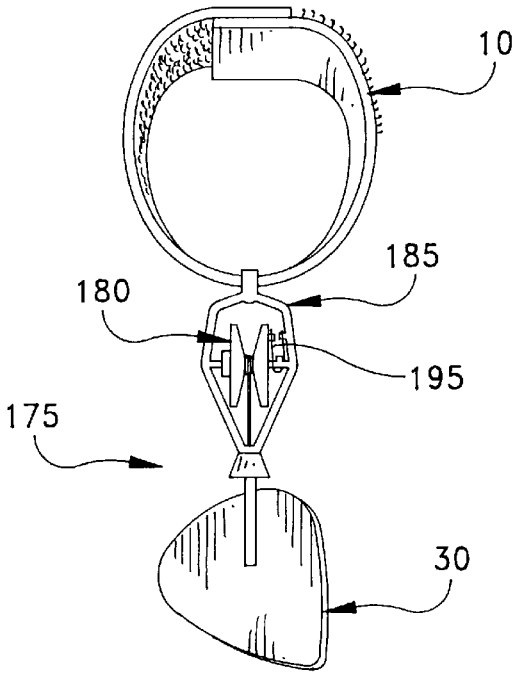
FIG. 16 is an elevational view of one alternative embodiment of the present invention illustrating a mechanically-implemented resilient member.
Figure 17:
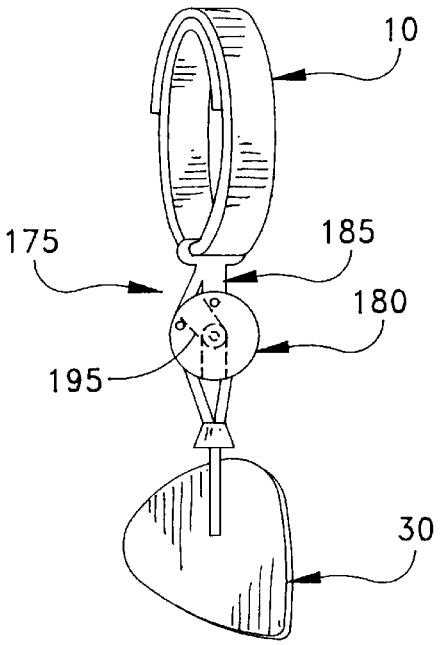
FIG. 17 is a side view of the plectrum holder shown in FIG. 16.
Figure 18:
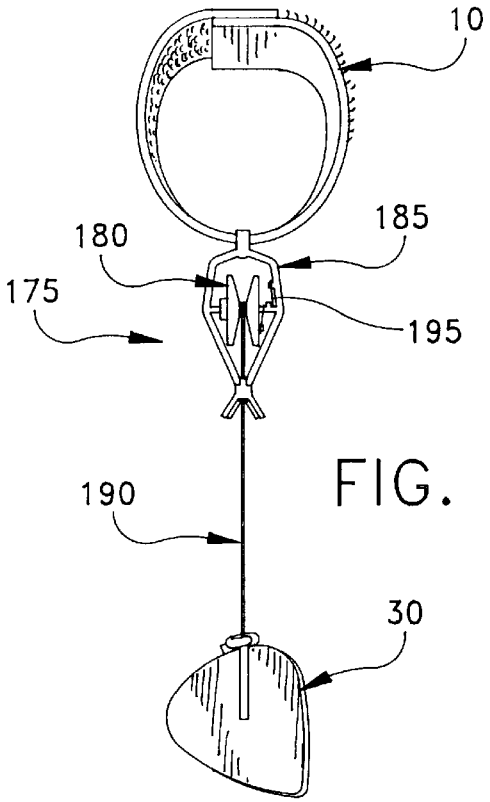
FIG. 18 is an elevational view of the plectrum holder illustrated in FIG. 16, but with the plectrum pulled away from a spring-biased reel.
Figure 19:
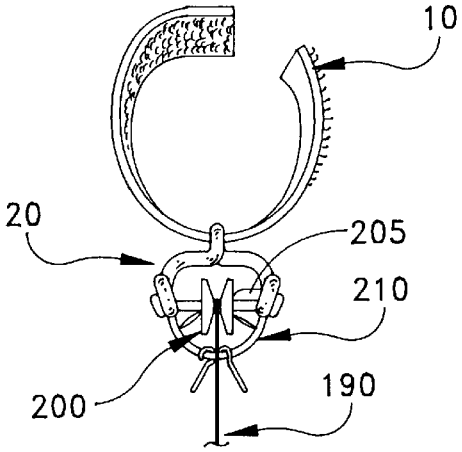
FIG. 19 shows yet a further embodiment of a mechanically-implemented resilient member.

In a further example shown in FIGS. 16–18, a mechanically-implemented resilient member 175 comprises a spring-biased reel 180 disposed on a yoke 185, with a tether line or filament 190 fastened to spring-biased reel 180 and plectrum 30. Mechanically-implemented resilient member 175 may comprise a reel biased by a torsion spring 195 or a reel 200 may comprise another elastic member 205, such as a rubber band that is operatively fastened to a corresponding yoke 210, as shown in FIG. 19. In any case, it will be appreciated that tether line or filament 190 preferably pays-out from spring-biased reel 180 under the influence of a relatively light tension applied to plectrum 30.

ADVANTAGES OF THE INVENTION

Numerous advantages are obtained by employing the present invention.

More specifically, a novel apparatus for holding a plectrum in graspable relation to a musician's hand is provided which avoids all of the aforementioned problems associated with prior art devices.

In addition, a plectrum holder is provided that maintains a plectrum in easily retrievable relation to a musician's finger tips, while that musician is finger-picking a stringed instrument, but that does not interfere with the finger-picking technique of the musician.

Furthermore a plectrum holder is provided that maintains a plectrum in a preferred orientation relative to a musician's fingers.

Also, a novel apparatus for holding a plectrum in graspable relation to a musician's fingers is provided comprising a resilient member that projects outwardly from the palm-side of a musician's hand.

Furthermore, a novel apparatus for holding a plectrum in graspable relation to a musician's fingers is provided wherein the plectrum is disposed in spaced-relation to the palm-side of the musician's hand while the musician is finger-picking a stringed instrument.

Also, a plectrum holder is provided that is capable of securely holding a plectrum safely in reserve so that it may be easily retrieved without introducing undesirable delays into the musical performance.

Furthermore, a novel method of playing a stringed instrument is taught.

It is to be understood that the present invention is by no means limited to the particular constructions herein disclosed and shown in the drawings, but also comprises any modifications or equivalents within the scope of the claims.

What is claimed is:

1. Apparatus for holding a plectrum in graspable relation to a hand, comprising:

means for engaging a portion of said hand;

a resilient member having a distal end and a proximal end wherein said resilient member comprises a spring-biased reel disposed on a yoke, having a tether line fastened to said spring-biased reel and said plectrum, said proximal end of said resilient member including means for fastening said resilient member to said hand engaging means so that said resilient member projects outwardly from said hand whereby said distal end of said resilient member is positioned in spaced-relation to said hand; and means for fastening said distal end of said resilient member to said plectrum.

* * * * *